US009512690B2

(12) United States Patent
Grigor et al.

(10) Patent No.: US 9,512,690 B2
(45) Date of Patent: Dec. 6, 2016

(54) MILLING CUTTER HAVING UNDULATING CHIP BREAKER

(71) Applicant: Smith International, Inc., Houston, TX (US)

(72) Inventors: Charles Grigor, Houston, TX (US); Kenneth M. Nevlud, Tomball, TX (US)

(73) Assignee: Smith International, Inc., Houston, TX (US)

( * ) Notice: Subject to any disclaimer, the term of this patent is extended or adjusted under 35 U.S.C. 154(b) by 382 days.

(21) Appl. No.: 14/107,918

(22) Filed: Dec. 16, 2013

(65) Prior Publication Data

US 2014/0166305 A1 Jun. 19, 2014

Related U.S. Application Data

(60) Provisional application No. 61/738,854, filed on Dec. 18, 2012.

(51) Int. Cl.
*E21B 29/00* (2006.01)
*E21B 10/56* (2006.01)

(52) U.S. Cl.
CPC ..... *E21B 29/002* (2013.01); *E21B 2010/566* (2013.01)

(58) Field of Classification Search
CPC ..... E21B 29/002; E21B 2010/566
See application file for complete search history.

(56) References Cited

U.S. PATENT DOCUMENTS 4,710,074 A 12/1987 Springer
4,717,290 A 1/1988 Reynolds et al.
5,012,863 A 5/1991 Springer
5,038,859 A 8/1991 Lynde et al.
5,070,952 A * 12/1991 Neff ..... E21B 10/322 166/55.7
5,626,189 A 5/1997 Hutchinson
5,772,365 A 6/1998 Vogel et al.
5,908,071 A 6/1999 Hutchinson et al.
5,984,005 A * 11/1999 Hart ..... E21B 10/5673 166/55.6

(Continued)

FOREIGN PATENT DOCUMENTS

DE 202004015757 U1 7/2005
EP 0515004 A1 11/1992

(Continued)

OTHER PUBLICATIONS

Danford, Matt; "Alternate Tool Material for Hogging Large Workpieces"; Modern Machine Shop; Sep. 17, 2008, accessed at: http://www.mmsonline.com/articles/alternate-tool-material-for-hogging-large-workpieces.

(Continued)

*Primary Examiner* — Brad Harcourt

(57) ABSTRACT

A cutting element includes a front face and leading face extending between a first and second sides. A leading cutting edge is located at an intersection of the front face and the leading face, and an undulating back-up cutting edge is formed in the front face and extends from the first side to the second side, and defines a leading surface and a trailing surface. A method includes cutting with a tool having a blade coupled to a tool body, and a cutting element coupled to a forward surface of the blade. The cutting element has a leading cutting edge formed at an intersection of front and leading faces, and an undulating back-up cutting edge formed in the front face and defining leading and trailing surfaces. The leading cutting edge of the cutting element contacts and cuts a work piece.

21 Claims, 6 Drawing Sheets

(56) References Cited

U.S. PATENT DOCUMENTS

| | | | |
|---|---|---|---|
| 6,715,966 | B2 | 4/2004 | Tsuzuki et al. |
| 6,913,426 | B2 | 7/2005 | Horiike et al. |
| 7,241,089 | B2 | 7/2007 | Mast et al. |
| 7,320,564 | B2 | 1/2008 | Gati |
| 7,544,024 | B2 | 6/2009 | Omori et al. |
| 8,007,209 | B2 | 8/2011 | Maushart et al. |
| 8,047,747 | B2 | 11/2011 | Flynn et al. |
| 8,434,572 | B2 | 5/2013 | Stowe, II et al. |
| 2007/0098506 | A1 | 5/2007 | Flynn |
| 2007/0122241 | A1 | 5/2007 | Sichi et al. |
| 2007/0248422 | A1 | 10/2007 | Song |
| 2010/0310329 | A1 | 12/2010 | Harif |
| 2011/0315455 | A1 | 12/2011 | Stowe et al. |
| 2012/0020749 | A1 | 1/2012 | Maeda et al. |

FOREIGN PATENT DOCUMENTS

| | | | |
|---|---|---|---|
| JP | 9029530 | A | 2/1997 |
| WO | 9423875 | A1 | 10/1994 |
| WO | 03039797 | A2 | 5/2003 |
| WO | 2010096280 | A2 | 8/2010 |
| WO | 2011017146 | A2 | 2/2011 |
| WO | 2012094796 | A1 | 7/2012 |

OTHER PUBLICATIONS

Dombovari, Zoltan; Stepan, Gabor; "The Effect of Helix Angle Variation on Milling Stability"; JOurnal of Manufacturing Science and Engineering, Transactions of the ASME; vol. 134, Iss. 5, Oct. 2012 (6 pages).

Mielert, Wolfried; "Smoother Roughing", May 2000, vol. 52, No. 5, available at: http://webcache.googleusercontent.com/search?q=cache:aIT7thpmEXIJ:www.ctemag.com/dynamic.articles.php%3Fid%3D244&hl=en&gl=us&strip=1 (3 pages).

"New Composite Milling Tools"; LMT-ONSRUD, accessed at http://www.onsrud.com/plusdocs/Doc/index.html?model.code=New-Diamond-Coated-Parabolic-Drill-by-Onsrud, Dec. 13, 2013 (2 pages).

"Powermill Milling Inserts"; Greenleaf Global Support Center, accessed at http://www.greenleafglobalsupport.com/webapp/wcs/stores/servlet/Product__10001__10001__-1__10119, Dec. 13, 2013 (1 page).

Wang, J.; Yang, C.S.; "Angle and Frequency Domain Force Models for a Roughing End Mill with a Sinusoidal Edge Profile"; International Journal of Machine Tools & Manufacture; 2003, pp. 1509-1520; vol. 43, No. 14.

International Search Report and Written Opinion issued in PCT/US2013/075589 on Apr. 16, 2014, 19 pages.

* cited by examiner

MILLING CUTTER HAVING UNDULATING CHIP BREAKER

CROSS-REFERENCE TO RELATED APPLICATIONS

This application claims the benefit of, and priority to, U.S. Patent Application No. 61/738,854, filed Dec. 18, 2012 and entitled "Downhole Milling Cutter Having Undulating Chip Breaker," which application is expressly incorporated herein by this reference in its entirety.

BACKGROUND

Downhole milling tools may be used to, for example, form casing windows or remove entire sections of downhole casing. Downhole milling tools may also be used to remove metallic debris—known as "junk"—that has fallen into the wellbore.

Downhole milling tools may include a tubular body having a plurality of equi-azimuthally spaced cutting blades coupled to the body. Each cutting blade has a forward surface facing the direction of rotation of the tool which is dressed with a cutting material (e.g., one or more cutting elements disposed in an outer surface of the cutting blade). The cutting material may include or define a protruding ridge or chip breaker, which is a projection that limits the length of swarf or chip cut by the leading cutting edge of the element.

Chip breakers are used to prevent or reduce "birdnesting," which is the term given to the long spirals of swarf that are cut from a tubular member (e.g., casing), that form into a conglomerate mass, which may restrict the flow of drilling mud about a tool, reduce the rate of penetration of the tool, and reduce the ability to carry cuttings back to the surface. Chip breakers may control the size of chips formed by the cutting element to increase the speed and efficiency of milling.

SUMMARY

In one aspect, embodiments disclosed herein relate to a cutting element including front and leading faces extending between first and second sides of the cutting element. A leading cutting edge is formed at an intersection of the front face and the leading face. An undulating back-up cutting edge is formed on the front face and extends from the first side to the second side. The undulating back-up cutting edge includes a leading surface and a trailing surface.

In another aspect, embodiments disclosed herein relate to a downhole tool including a tool body and a blade coupled to the tool body. The blade includes a forward surface and a cutting element is coupled to the forward surface. The cutting element includes a front and leading faces extending between first and second sides of the cutting element. A leading cutting edge formed at an intersection of the front face and the leading face. An undulating back-up cutting edge is formed in the front face and forms a leading surface and a trailing surface extending from the first side to the second side.

In yet another aspect, embodiments disclosed herein relate to a method of cutting with a downhole tool including deploying a downhole tool to a downhole position in a borehole. The downhole tool includes a tool body and a blade coupled to the tool body. The blade has a forward surface and a cutting element coupled to the forward surface. The cutting element includes a leading cutting edge formed at an intersection of a front face and a leading face of the cutting element. The cutting element also includes an undulating back-up cutting edge formed in the front face extending from a first side to a second side of the cutting element and forming a leading surface and a trailing surface. The leading cutting edge of the cutting element is contacted with a work piece and the downhole tool is rotated and translated.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF DRAWINGS

One or more embodiments of a milling cutter having an undulating chip breaker are hereinafter described with reference to the figures described below. The figures are drawn to a scale which may be utilized in some embodiments of the present disclosure, and which may be used for determining relative dimensions, shapes, and configurations of certain features. The figures should not, however, be interpreted as scaled representations of each embodiment of the present disclosure, as the figures schematically represent other embodiments in which dimensions and features may be compressed, stretched, or otherwise modified from those illustrated in the following figures.

DETAILED DESCRIPTION

In one aspect, one or more embodiments disclosed herein relate to a cutting element for a milling tool which incorporates an undulating back-up cutting edge which may act as a chip breaker. In another aspect, one or more embodiments disclosed herein relate to a downhole milling tool which includes a cutting element having an undulating back-up cutting edge. In yet another aspect, one or more embodiments disclosed herein relate to a method of cutting with a milling tool which includes a cutting element having an undulating back-up cutting edge.

Figure 1:
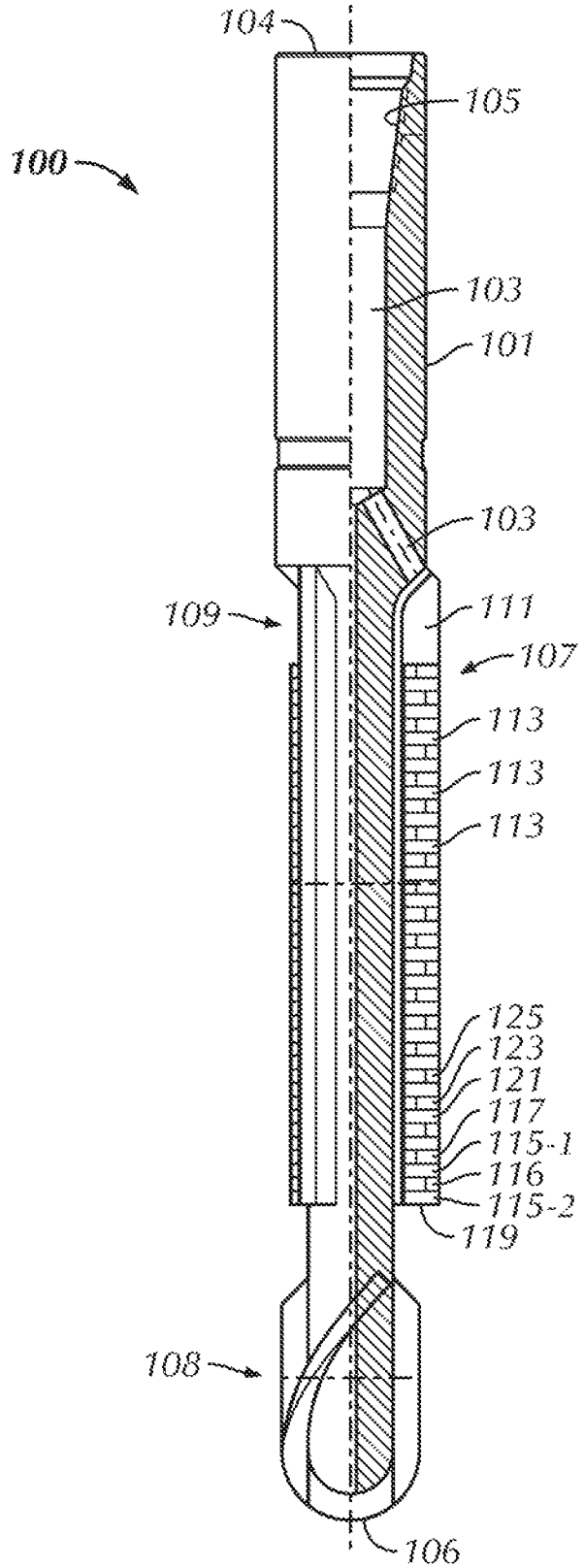
FIG. 1 is a partial cross-sectional view of a downhole milling cutter having an undulating chip breaker in accordance with embodiments disclosed herein.

Referring to FIG. 1, a partial cross-sectional view of a downhole milling tool 100 is shown in accordance with embodiments disclosed herein. The downhole milling tool 100 may have a tubular, substantially circular body 101 extending in a longitudinal direction from an upper end portion 104 to a lower end portion 106. The downhole milling tool 100 may include an axial passage 103 therethrough for the circulation of fluid. The upper end portion 104 of the body 101 may include an internal screw thread 105 for connecting the body 101 to a drill string (not shown). A lower end portion 106 of the body 101 may have a "bull nose" 108 positioned to stabilize the milling tool within the borehole. The body 101 may have three, equi-azimuthally spaced longitudinal blades (two shown) 107, 109. One of ordinary skill in the art will appreciate that the downhole milling tool 100 may have fewer or more than three blades and that the blades may or may not be equally spaced about tool 100. A plurality of cutting elements 113 may be disposed on a forward surface 111 of each blade 107, 109 (i.e., facing forwardly in the direction of rotation of the downhole milling tool 100). The cutting elements 113 may be coupled to each blade 107, 109 by any convenient means known in the art such as by brazing, welding, soldering, mechanical fastening, or any combination of the foregoing.

Figure 2:
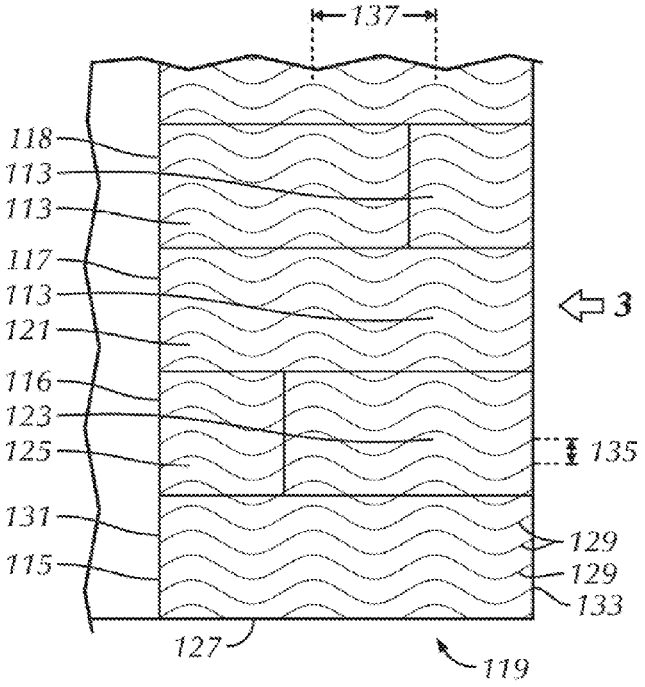
FIG. 2 is a detail view of the lower edge of the downhole milling cutter of FIG. 1.
Figure 3:
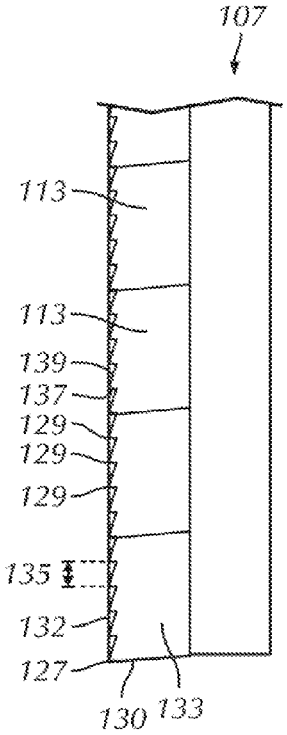
FIG. 3 is a side view of the downhole milling cutter of FIG. 2 taken from the direction of the arrow 3 in FIG. 2.

Referring now to FIGS. 1-3, the cutting elements 113 may be positioned in radial rows 115-118. The cutting elements 113 may be disposed in a "brickwork" pattern. In other words, by using cutting elements 113 of varying widths and/or offsetting some of the cutting elements 113, the interface of radially adjacent cutting elements 113 may not be aligned with an interface of the cutting elements 113 of an adjacent longitudinal row. Now referring to FIG. 2, the cutting elements 113 may have differing widths so that some cutting elements are wider than others. For example, in FIG. 2, wide cutting element 121 is wider than intermediate cutting element 123, which is in turn wider than narrow cutting element 125. In one embodiment, the odd numbered rows 115, 117, as counted from a lower edge 119 of the blade 107, may include one wide cutting element 121. Rows 116 and 118 (both even numbered rows as counted from lower edge 119 of blade 107) may include an intermediate cutting element 123 and a narrow cutting element 125. Alternating rows 116, 118 may alternate the positions of the intermediate cutting element 123 and narrow cutting element 125. In other embodiments, other layouts of the cutting elements 113 are contemplated. For instance, even numbered rows may include wide cutting elements 121, and odd numbered rows may include one narrow cutting element 125 and one intermediate cutting element 123. In still other embodiments, some odd and even numbered rows may include wide cutting elements 121, intermediate cutting elements 123, or narrow cutting elements 125, or some combination of the foregoing. In still other embodiments, rather than, or in addition to, the horizontal configuration of the rows 115-118 shown in FIG. 2, the rows 115-118 may be angled across the blade 107, or may be vertically aligned.

In the embodiment of FIGS. 1-3, the cutting elements 113 may be placed in an abutting radial and longitudinal relationship relative to one another, though one having ordinary skill in the an will understand in view of the disclosure herein that the cutting elements 113 may be spaced apart from one another longitudinally, radially, or both longitudinally and radially. Likewise, the blades 107, 109 of the downhole tool 100 may be illustrated as having a zero or neutral rake angle and/or a zero or neutral lead angle, though one having ordinary skill in the art will understand in view of the disclosure herein that the downhole tool may be designed to position the blades to include a positive or negative rake and/or lead angle. Furthermore although the cutting elements 113 shown are rectangular and described in rectangular terms, one having ordinary skill in the art would understand that the cutting elements could comprise any shape such as, for example, a rectangle, triangle, rhomboid, star-shape, etc. Other shaped-cutting elements may also be used to form a brickwork pattern in some embodiments. In some embodiments, the cutting elements 113 may be formed as wafers having a rectangular, triangular, rhomboidal, star-shaped, circular, cylindrical, etc. shape. In such an embodiment, and as shown and described herein, cutting edges may extend side-to-side along the wafer (e.g., in an undulating pattern). Such cutting edge may be contrasted with a helical cutting edge extending between a top and bottom of a drill bit or other cutting element.

Figure 4:
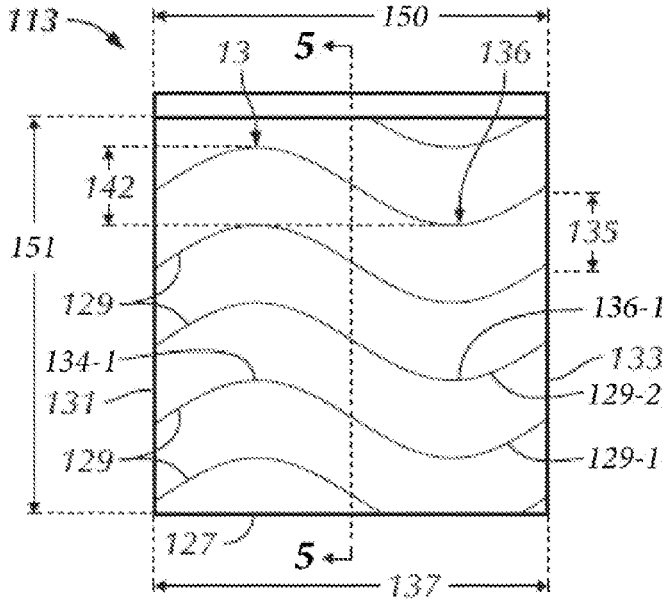
FIG. 4 is an elevation view of a lowermost cutting element in accordance with embodiments disclosed herein.

Referring now to FIGS. 2 and 3, each cutting element 113 may have a first side 131, a second side 133, a leading face 130, and a front face 132. The intersection of the leading face 130 and the front face 132 forms a leading cutting edge 127. A plurality of undulating back-up cutting edges 129 may be formed in the front face 132. Each undulating back-up cutting edge 129 may extend from the first side 131 to the second side 133 of the cutting element 113. As illustrated in FIG. 4, each undulating back-up cutting edge 129 may vary in distance from the leading cutting edge 127 across the front face 132 of cutting element 113 (i.e., from the first side 131 to the second side 133), forming a series of one or more high points 134 and one or more low points 136. Each undulating back-up cutting edge 129-1 may be longitudinally spaced from an adjacent undulating back-up cutting edge 129-2 by a selected distance 135. The high points 134 and low points 136 of each undulating back-up cutting edge 129 may substantially align, so that adjacent undulating back-up cutting edges 129 remain the selected distance 135 apart across the front face 132 of the cutting element 113, although in other embodiments the selected distance 135 may vary across the front face 132 of the cutting element 113. Each undulating back-up cutting edge 129 may have a period 137. The period 137 may be measurable from, for example, a high point 134 to an adjacent high point (or a low point 136 to an adjacent low point, or as shown in FIG. 4, from a midpoint to a midpoint) on the same undulating back-up cutting edge 129. Period 137 may relate to a width 150 of the cutting element 113 so that the undulating back-up cutting edges 129 of radially adjacent cutting elements 113 form a continuous edge profile across the interface between cutting elements 113. Likewise, the selected distance 135 may relate to a height 151 of the cutting element 113 so that the undulating back-up cutting edges 129 of longitudinally adjacent cutting elements 113 may also form a continuous edge profile across the interface between cutting elements 113. Optionally, the selected distance 135 may relate to an amplitude 142, measured between the high points 134 and low points 136 of an undulating back-up cutting edge 129. In some embodiments, the high point 134-1 of one undulating back-up cutting edge 129-1 may be farther from the leading cutting edge 127 than the low point 136-1 of the next adjacent undulating back-up cutting edge 129-2. In other embodiments, the high point 134-1 of one undulating back-up cutting edge 129-1 may near or about the same distance from the leading cutting edge 127 relative to the low point 136-1 of the next adjacent undulating back-up cutting edge 179-2.

Figure 5:
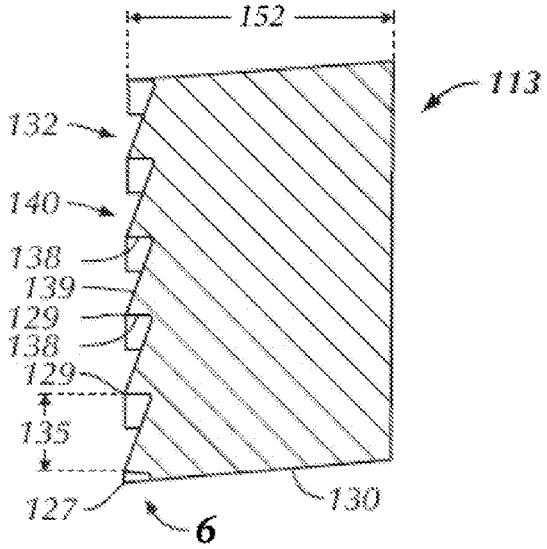
FIG. 5 is a cross-sectional view of the cutting element of FIG. 4 taken at line 5-5.

Referring to FIG. 5, each undulating back-up cutting edge 129 may form a leading surface 138 and a trailing surface 139. The leading surface 138 of each undulating back-up cutting edge 129 may intersect the trailing surface 139 of the adjacent undulating back-up cutting edge 129. Each trailing surface 139 may then intersect the leading surface 138 of the next undulating back-up cutting edge 129. The leading surface 138 of each undulating back-up cutting edge 129 may face the leading cutting edge 127 of the cutting element 113. The leading surface 138 and the trailing surface 139 may define a recessed portion 140 between the adjacent undulating back-up cutting edges 129.

One of ordinary skill in the art will appreciate in view of the disclosure herein that the dimensions of a cutting element 113—including width 150, height 151, a depth 152, selected distance 135, period 137, and amplitude 142—may vary. For example, the height 151 may be between 0.1 inch (2.5 mm) and 3 inches (76 mm) and the width 150 may be between 0.1 inch (3 mm) and 6 inches (152 mm). In other embodiments, the height 151 may be between 0.3 inch (8 mm) and 0.5 inches (13 mm), and the width 150 may be between 0.3 inch (8 mm) and 1.5 inches (38 mm). In still other embodiments, where more than one cutting element 113 is used, one cutting element 113 may have a width 150 different from the width 150 of a second cutting element 113. One of ordinary skill in the art will appreciate in view of the disclosure herein that the various dimensions of the cutting elements 113 may vary independent of other dimensions. For example, the width 150 may vary independently of the period 137. Additionally, one of ordinary skill in the art will appreciate in view of the disclosure herein that the depth 152 may be between 0.05 inch (1 mm) and 1 inch (25 mm). In other embodiments, the depth 152 may be between 0.2 inch (5 mm) and 0.5 inch (13 mm). It will be understood that these dimension values are meant as examples and do not limit the scope of embodiments disclosed herein.

In some embodiments, the selected distance 135 may be between 0.03 inch (1 mm) and 0.15 inch (4 mm), the amplitude 142 may be between 0.03 inch (1 mm) and 0.15 inch (4 mm), and the period 137 may be between 0.25 inch (6 mm) and 1.5 inch (38 mm). In other embodiments, the selected distance 135 may be between 0.07 inch (1.8 mm) and 0.09 inch (2.3 mm), the amplitude 142 may be between 0.075 inch (1.9 mm) and 0.095 inch (2.4 mm), and the period 137 may be between 0.3 inch (8 mm) and 0.5 inch (13 mm). It will be understood that these dimension values are meant as examples and do not limit the scope of embodiments disclosed herein. Furthermore, will be understood that the selected distance 135, amplitude 142, and period 137 may each vary independently of any one or more of the width 150, height 151, or depth 152. The number of undulating back-up cutting edges 129 may vary. In some embodiments, there may be between two and ten (or more) undulating back-up cutting edges 129. In other embodiments, there may be between three and seven undulating back-up cutting edges 129. In still other embodiments, there may be between four and six undulating back-up cutting edges 129. Moreover, due to the undulating nature of the back-up cutting edges 129, there may be different numbers of undulating back-up cutting edges 129 at different positions along the width 150 of the cutting element 113. The number of undulating back-up cutting edges 129 may also vary as the cutting element 113 is eroded as discussed in more detail herein.

Figure 6:
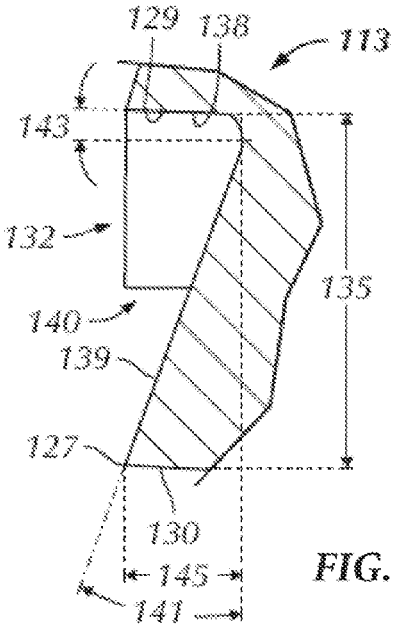
FIG. 6 is a detail view of the cutting element of FIG. 5.

FIG. 6 illustrates a detail view at 6 of FIG. 5. As shown, the leading cutting edge 127 may define an axial rake angle 141 between the first trailing surface 139 and a line perpendicular to the leading face 130 of cutting element 113 (or parallel to the axis of the cutting tool and/or borehole). In some embodiments, the axial rake angle may be between about 0° and about 30°, though one having ordinary skill in the art will appreciate in view of the disclosure herein that this angle may vary. Additionally, each of the undulating back-up cutting edges 129 may define a land angle 143 as measured between leading surface 138 of the undulating back-up cutting edge 129 and a line perpendicular to the front face 132 of cutting element 113. In some embodiments, the land angle 143 may be between about 0.1° and about 15°. The leading surface 138 may extend from the trailing surface 139 by distance 145. In some embodiments, the distance 145 may be between about 0.005 inch (0.1 mm) and 0.25 inch (6 mm). It will be understood that these dimensions are meant as examples and do not limit the scope of embodiments disclosed herein. Cutting elements 113 may be formed from any material known in the art, for example, tungsten carbide, diamond (e.g., synthetic, natural, polycrystalline), tool steel, high speed steel, titanium carbide, cubic boron nitride, etc.

Figure 7:
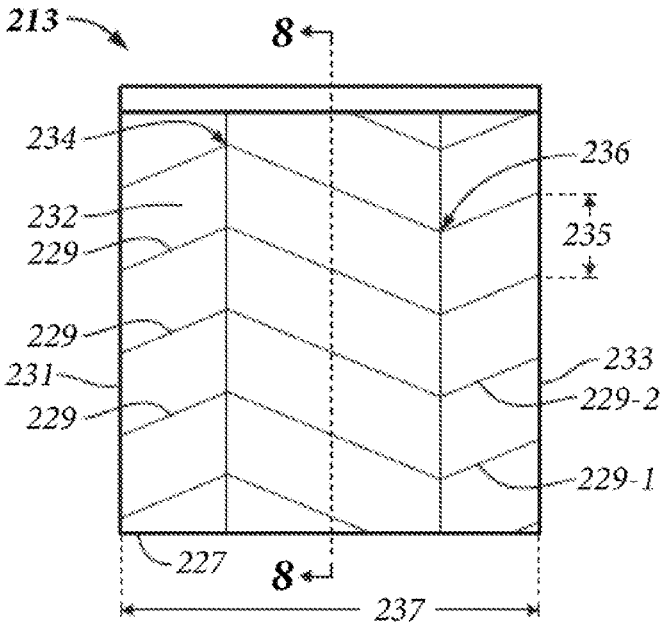
FIG. 7 is an elevation view of a cutting element in accordance with embodiments disclosed herein.
Figure 8:
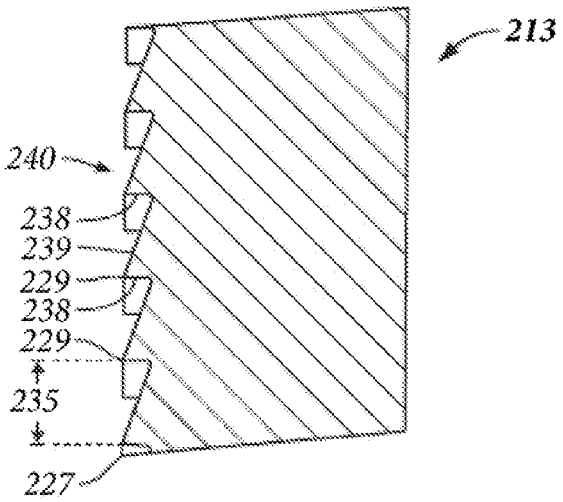
FIG. 8 is a cross-sectional view of the cutting element of FIG. 7 taken at line 8-8.
Figure 9:
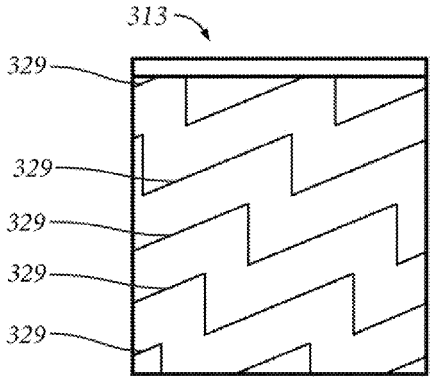
FIG. 9 is an elevation view of a cutting element in accordance with embodiments disclosed herein.
Figure 10:
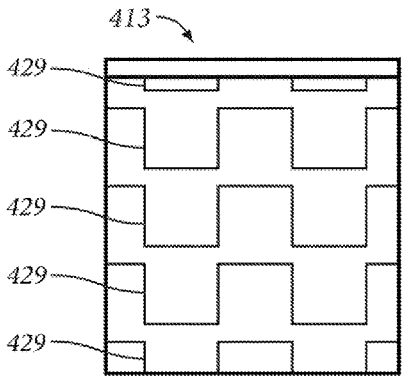
FIG. 10 is an elevation view of a cutting element in accordance with embodiments disclosed herein.

The undulating back-up cutting edges 129 so far depicted have had curvilinear undulations. For example, in some embodiments, the undulating back-up cutting edges 129 may be in the shape of sinusoidal curves extending from the first side 131 to the second side 133 as shown in FIGS. 1-4. The undulating back-up cutting edges 129 may, however, have other shapes that fall within the scope of this disclosure. For example, FIGS. 7 and 8 depict a further embodiment of a cutting element 213 having undulating back-up cutting edges 229 formed in a front face 232 of cutting element 213. The undulating back-up cutting edges 229 may vary in distance from the leading cutting edge 227, forming sets of one or more high points 234 and sets of one or more low points 236. Here, the undulating back-up cutting edges 229 may have non-smooth, or abrupt undulations, and the high points 234 and low points 236 may be located at abrupt transitions. In FIGS. 7 and 8, the abrupt transitions at the high points 234 and low points 236 may include intersections of straight line segments. As used herein, cutting edges with abrupt or non-smooth undulations refer to cutting edges that do not have a curvilinear profile. For example, the undulating back-up cutting edges 229 may be in the shape of a triangular waveform producing triangular undulations. In other embodiments, however, the undulating back-up cutting edges may have other forms or profiles. For instance, FIG. 9 illustrates a cutting element 313 having undulating back-up cutting edges 329 in the shape of a sawtooth waveform such that the undulating back-up cutting edges 329 produce sawtooth undulations. FIG. 10 illustrates another example cutting element 414 having undulating back-up cutting edges 429 in the shape of a square waveform such that the undulating back-up cutting edges 429 produce square undulations.

With continued reference to FIGS. 7 and 8, the cutting element 213 may have a leading cutting edge 227. The leading cutting edge 227 and the undulating back-up cutting edges 229 may extend from a first side 231 to a second side 233 of the cutting element 213. Each undulating back-up cutting edge 229 may be longitudinally spaced from an adjacent undulating back-up cutting edge 229 by a selected distance 235. The high points 234 and low points 236 of each undulating back-up cutting edge 229 may substantially align, so that adjacent undulating back-up cutting edges 229 remain the selected distance 235 apart across the front face 232 of the cutting element 213 (i.e., from the first side 231 to the second side 233). Each undulating back-up cutting edge 229 may have a period 237, measured from, for example, a high point 234 to an adjacent high point, a low point 236 to an adjacent low point, or a middle point to an adjacent middle point on the same undulating back-up cutting edge 229.

Referring to FIG. 8, each undulating back-up cutting edge 229 may form a leading surface 238 and a trailing surface 239. The leading surface 238 of each undulating back-up cutting edge 229 may intersect the trailing surface 239 of the next adjacent undulating back-up cutting edge 229. Each trailing surface 239 may then intersect the leading surface 238 of the next undulating back-up cutting edge 229. The leading surface 238 of each undulating back-up cutting edge 229 may face the leading cutting edge 227 of the cutting element 213. The leading surface 238 and the trailing surface 239 may define a recessed portion 240 between adjacent undulating back-up cutting edges 229.

Depending on the work piece to be cut, for example, a downhole milling tool may have different configurations with different blade geometries and varying cutting element placement so that a leading cutting edge is aligned with the work piece. Work pieces may include, for example, plugs (e.g., bridge plugs), tubulars (e.g., other tools, casing, liners, etc.), downhole restrictions, broken tool components (e.g., roller cones and hand tools dropped down a borehole from the surface), and the like. One or more embodiments of a downhole milling tool may include a pilot mill, an expandable section mill, a taper mill, a junk mill, a follow mill, a dress mill, or a lead mill depending on the desired use. One or more embodiments may include, for example, the downhole milling tool 100 in FIG. 1 arranged and designed to cut downhole casing in a longitudinal direction with a planar cut orthogonal to the longitudinal direction. Therefore, the lower end portion 119 of the blades 109, 111 may extend substantially radially from the tool body 101, about perpendicular to the longitudinal axis of the borehole. The cutting elements 113 may be mounted so that the leading cutting edge 127 also extends substantially radially from the tool body 101, about perpendicular to the longitudinal axis of the borehole.

Figure 11:
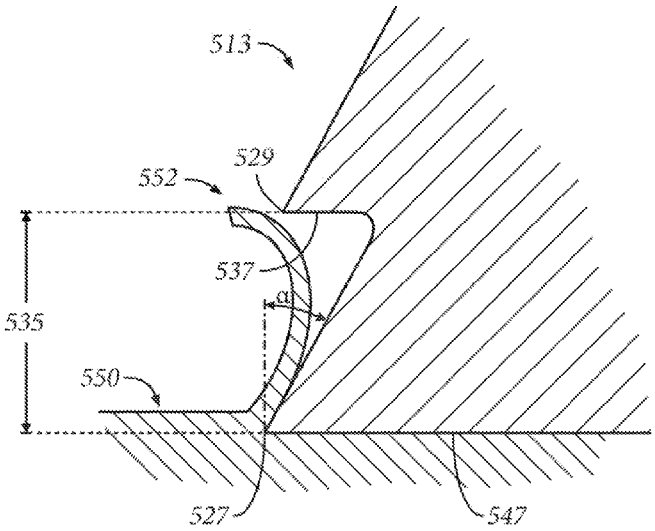
FIG. 11 is a detail cross-sectional view of a leading cutting edge of a cutting element shaving a chip from a work piece in accordance with embodiments disclosed herein.

Referring to FIG. 11, during operation of a downhole milling tool (e.g., downhole milling tool 100 of FIG. 1), the downhole milling tool may be lowered into a borehole on a drill string. The cutting element 513 may be placed in contact with a work piece 550. FIG. 11 depicts the cutting element 513 having a positive rake angle $\alpha$, but one skilled in the art will understand in view of the disclosure herein that a negative or neutral rake angle may also be used and remain within the scope of this disclosure. The tool may then be rotated, also causing the cutting element 513 to rotate. The leading cutting edge 527 contacts the work piece 550, and shaves a chip 552 from a top layer or exposed surface of the work piece 550. The chip 552 continues to grow (i.e., lengthen) as more material from the work piece 550 is removed. When the chip 552 grows to a certain length, the chip 552 contacts the leading face 537 of the next undulating back-up cutting edge 529. This contact may cause additional stress within the chip 552, eventually causing the chip 552 to break from the work piece 550. The distance 535 between the leading cutting edge 527 and the undulating back-up cutting edge 529 may determine the size of the chip 552 when it is broken off from the work piece 550.

Without the undulating back-up cutting edge 529, the chip 552 may grow unbounded into a long, tangled strand. Such a strand may wrap around the drill string, clog the borehole around the drill string, or even cut casing around the rotating drill string. This birdnesting may reduce the effectiveness and/or efficiency of a milling operation. As chips 552 are removed from the work piece 550, the corresponding downhole milling tool may be steadily lowered or translated further into the borehole.

Figure 12:
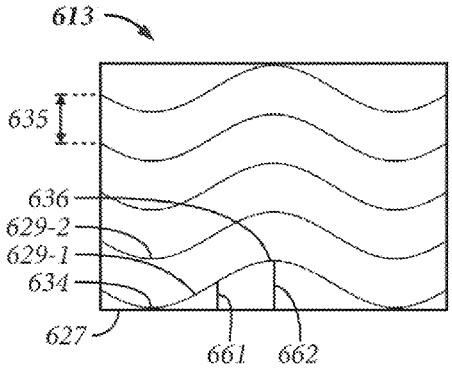
FIG. 12 is an elevation of a cutting element before erosion in accordance with embodiments disclosed herein.

Referring to FIG. 12, a front elevation view of a cutting element 613 is shown. Because of the varying distances 661, 662 of the leading cutting edge 627 to high points 636 and low points 634 of the undulating back-up cutting edge 629-1, chips cut by the cutting edge 629-1 are broken off at different lengths depending on where along the width of the leading cutting edge 627 they are formed. For instance, the distance 661 from the leading cutting edge 627 to the undulating back-up cutting edge 629-1 is less at a point near the low point 634 than the distance 662 at a point near the high point 636. Thus, a chip cut at 661 would be smaller than a chip cut at 662. Because the undulating back-up cutting edge 629-1 is periodic, chips are broken at a designed average chip length. This average chip length may be controlled by the selected distance 635 between the undulating back-up cutting edges 629-1, 629-2.

Referring back to FIG. 11, as the cutting element 513 slidingly contacts the work piece 550, a leading face 547 of the cutting element 513 may be eroded away, lowering the overall height 535 of the cutting element 513. As this occurs, the leading cutting edge 527 may continuously move up the face of cutting element 513. When the leading cutting edge 527 meets the leading surface 537, the undulating back-up cutting edge 529 becomes the new leading cutting edge.

Figure 13:
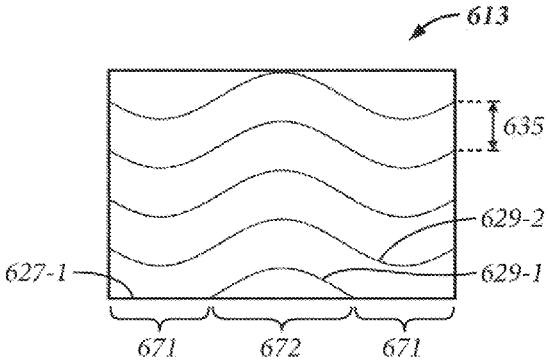
FIG. 13 is an elevation view of a cutting element after erosion in accordance with embodiments disclosed herein.

Referring to FIG. 13, the cutting element 613 is shown after the leading cutting edge 627 has been eroded back to a new leading cutting edge 627-1. As the undulating back-up cutting edge 629-1 is eroded, the next adjacent undulating back-up cutting edge 629-2 may act as a chip breaker for portions 671 of the leading cutting edge 627-1, while the undulating back-up cutting edge 629-1 continues to act as chip breaker for other portions 672 of the leading cutting edge 627-1. Because the undulating back-up cutting edges 629-1, 629-2 are spaced a distance 635 apart, the average chip length may remain substantially the same as the cutting element 613 is eroded. By maintaining a substantially stable average chip length throughout milling operations, the milling operation may proceed more expediently, as, for example, a feed rate—defined as the amount of the work piece 550 (FIG. 11) milled in a given amount of time—does not have to be varied in response to changing chip tenths resulting from erosion of the cutting element 613.

Figure 14:
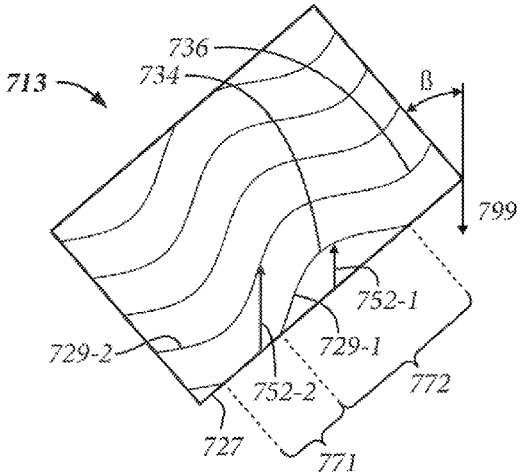
FIG. 14 is an elevation view of a cutting element in accordance with embodiments disclosed herein.

In other embodiments, a downhole milling tool may be a taper mill. In a taper mill, the blades may be positioned to cut away a casing at an angle relative to the longitudinal axis of the borehole and the downhole trajectory of the mill. In such a mill, FIG. 14 illustrates that the leading cutting edge 727 of a cutting element 713 may be oriented at an angle $\beta$ relative to the trajectory 799 of the mill. A chip cut by the cutting element 713 therefore may not travel perpendicularly from the leading cutting edge 727 to the next undulating back-up cutting edge (e.g., 729-1, 729-2). Instead, as shown in FIG. 14, a chip may follow an oblique path 752-1 to contact the undulating back-up cutting edge 729-1 at an angle. As the cutting element 713 wears and undulating hack-up cutting edge 729-1 is eroded, the next adjacent undulating back-up cutting edge 729-2 may act as a chip breaker for portion 771 of the leading cutting edge 727, while the undulating back-up cutting edge 729-1 may continue to act as a chip breaker for one or more other portions 772 of the leading cutting edge 727. Because a high point 734 of undulating back-up cutting edge 729-1 may be substantially the same distance from the leading cutting edge 727 as a low point 736 of the undulating back-up cutting edge 729-2, there may be little or no gap across the leading cutting edge for unrestrained chip growth, also known as birdnesting, as even a very oblique chip path 752-2 may still contact the next adjacent undulating back-up cutting edge 729-2. One having ordinary skill in the art will recognize in view of the disclosure herein that the high point 734 could be nearer to, or farther from, the leading cutting edge 727 than the low point 736 and still effect the disclosures herein. In an embodiment where a chip may pass through a gap between a high point 734 and a low point 736, the chip may grow into a very long strand which may lead to birdnesting and resulting damage.

Those of ordinary skill in the art will also appreciate in view of the disclosure herein that while the high points 734 and low points 736 of adjacent undulating back-up cutting edges 729-1, 729-2 may be generally aligned along the cutting element 713 (e.g., in a linear direction parallel the height of the cutting element 713, in a direction offset at an angle β relative to the trajectory 799 of the mill, etc); however, other embodiments are contemplated. For instance, a line drawn between high points 734 and/or low points 736 of adjacent undulating back-up cutting edges 729-1, 729-2 may be otherwise oriented. In some embodiments, for instance, a line drawn between high points 734 and/or low points 736 of the adjacent undulating back-up cutting edges 729-1, 729-2 may be about parallel to the trajectory 799 of the mill. In such an embodiment, the selected distance between the undulating back-up cutting edges 729-1, 729-2 may vary along the width of the cutting element 713 when measured in a direction parallel to the height of the cutting element 713, but may be constant when measured along one or more of the oblique chip paths 752-1, 752-2.

Select embodiments may reduce the length of cuttings shaved from the surface of a work piece and restrict and potentially eliminate birdnesting. In certain embodiments, an undulating back-up cutting edge may provide for a relatively stable average chip length throughout the operation of the downhole milling tool even as the cutting element is eroded.

In other embodiments, a method of cutting with a downhole tool is described, and may include providing a downhole milling tool. A blade for multiple blades) may be coupled to the body of the downhole milling tool may have a forward surface. One or more cutting elements may be coupled to the forward surface of the blade. The cutting element can include a front face extending between a first side and a second side, a leading face extending between the first and second side, and a leading cutting edge formed at an intersection of the front face and the leading face. Additionally, the cutting element may have an undulating back-up cutting edge formed in the front face extending from the first side to the second side, forming a leading surface and a trailing surface. The method may also include contacting the leading cutting edge of the cutting element with a work piece. The method may also include rotating and/or translating the downhole tool.

In some embodiments, a method may also include shaving a chip from the work piece, contacting the chip with the leading surface of the undulating back-up cutting edge, and breaking the chip from the work piece. The chip may be broken from the workpiece by a leading face of a next undulating back-up cutting edge. In some embodiments, the method may also include eroding the leading face of the cutting element, the eroding forming a second leading face of the cutting element and a second leading cutting edge formed at an intersection of the front face and the second leading face of the cutting element. The second leading cutting edge may be located at the next undulating back-up cutting edge.

In some embodiments, the method may also include eroding a portion of the undulating back-up cutting edge, shaving a second chip from the work piece with the second cutting edge, contacting the second chip with a second leading surface of a second undulating back-up cutting edge, and breaking the chip from the work piece. The second undulating back-up cutting edge may also be formed in the front face a selected distance from the undulating back-up cutting edge. In some embodiments, the method may also include determining a selected distance to optimize an average chip size.

Although only a few example embodiments have been described in detail above, those skilled in the art will readily appreciate that many modifications are possible in the example embodiments without materially departing from embodiments disclosed herein. Accordingly, any such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6, for any limitations of any of the claims herein, except for those in which the claim expressly uses the words 'means for' together with an associated function.

What is claimed is:

1. A cutting element comprising:
- a front face extending between a first side and a second side;
- a leading face extending between the first side and the second side;
- a leading cutting edge formed at an intersection of the front face and the leading face; and
- an undulating back-up cutting edge formed in the front face extending from the first side to the second side and forming a leading surface and a trailing surface, the leading surface of the undulating back-up cutting edge having a variable distance from the leading face and the leading cutting edge.

2. The cutting element as recited in claim 1, the undulating back-up cutting edge being curvilinear.

3. The cutting element as recited in claim 2, the undulating back-up cutting edge being substantially sinusoidal.

4. The cutting element as recited in claim 1, the undulating back-up cutting edge being triangular.

5. The cutting element as recited in claim 1, the undulating back-up cutting edge having a square or sawtooth profile.

6. The cutting element as recited in claim 1, the undulating back-up cutting edge being a first undulating back-up cutting edge, the cutting element further comprising:
- a second undulating back-up cutting edge formed in the front face a selected distance from the undulating back-up cutting edge and farther from the leading cutting edge than the first undulating back-up cutting edge.

7. The cutting element as recited in claim 6, a point of the first undulating back-up cutting edge farthest from the leading cutting edge being farther from the leading cutting edge than a point of the second undulating back-up cutting edge nearest the leading cutting edge.

8. The cutting element as recited in claim 6, the trailing surface of the first undulating back-up cutting edge intersecting a leading surface of the second undulating back-up cutting edge.

9. The cutting element as recited in claim 6, the selected distance being measured as a difference between the distance of the undulating back-up cutting edge and the second undulating back-up cutting edge from the leading cutting edge of the cutting element, the selected distance being constant along a width of the front face.

10. A downhole tool comprising:

a tool body;

a first blade coupled to the tool body, the first blade having a forward surface; and a cutting element coupled to the forward surface of the first blade, the cutting element having:

a front face extending between a first side and a second side;

a leading face extending between the first side and the second side;

a leading cutting edge formed at an intersection of the front face and the leading face; and a first undulating back-up cutting edge formed in the front face extending from the first side to the second side and forming a leading surface and a trailing surface, the leading surface of the first undulating back-up cutting edge having a variable distance from the leading cutting edge.

11. The cutting element as recited in claim 10, the undulating back-up cutting edge being substantially sinusoidal.

12. The cutting element as recited in claim 10, the undulating back-up cutting edge being triangular.

13. The downhole tool as recited in claim 10, further comprising:

a second blade coupled to the tool body and spaced azimuthally from the first blade, the second blade having a forward surface; and a second cutting element coupled to the forward surface of the second blade, the second cutting element having an undulating back-up cutting edge, the second cutting element being offset radially from the first cutting element coupled to the first blade.

14. The downhole tool as recited in claim 10, further comprising:

a second cutting element having an undulating back-up cutting edge, the second cutting element being positioned adjacent to the first cutting element such that the undulating back-up cutting edge of the second cutting element aligns with the undulating back-up cutting edge of the first cutting element so that the undulating back-up cutting edges of the first and second cutting elements form a substantially continuous undulating back-up cutting edge profile across the interface between the first and second cutting elements.

15. The downhole tool as recited in claim 10, further comprising:

a plurality of additional cutting elements, each cutting element of the plurality of additional cutting elements having an undulating back-up cutting edge, the plurality of cutting elements extending both in radial and longitudinal directions over the forward surface of the first blade.

16. A method of cutting with a downhole tool comprising:

deploying a downhole tool to a downhole position in a borehole, the downhole tool having:

a tool body;

a blade coupled to the tool body having a forward surface; and a cutting element coupled to the forward surface of the blade, the cutting element having:

a leading cutting edge formed at an intersection of a front face and a leading face of the cutting element; and an undulating back-up cutting edge formed in the front face extending from a first side to a second side of the cutting element and forming a leading surface and a trailing surface, the leading surface of the undulating back-up cutting edge having a variable distance from the leading cutting edge;

contacting the leading cutting edge of the cutting element with a work piece; and rotating and translating the downhole tool.

17. The method as recited in claim 16, further comprising:

shaving a chip from the work piece using the leading cutting edge of the cutting element; and breaking the chip from the work piece by contacting the chip with the leading surface of the undulating back-up cutting edge.

18. The method as recited in claim 17, further comprising:

eroding the leading face of the cutting element, the eroding forming:

a second leading face of the cutting element, and a second leading cutting edge formed at an intersection of the front face and the second leading face of the cutting element.

19. The method as recited in claim 18, further comprising:

eroding a portion of the undulating back-up cutting edge;

shaving a second chip from the work piece with the second leading cutting edge; and breaking the second chip from the work piece by contacting the second chip with a second leading surface of a second undulating back-up cutting edge, the second undulating back-up cutting edge being formed in the front face a selected distance from the undulating back-up cutting edge.

20. The method as recited in claim 19, the cutting element further having a second undulating back-up cutting edge formed in the front face a selected distance from the undulating back-up cutting edge, the selected distance optimizing an average chip size.

21. The method as recited in claim 20, the work piece including one or more of a plug, tubular, downhole restriction, broken tool component, or hand tool.

* * * * *